United States Patent [19]

Wetzel

[11] Patent Number: 4,640,370

[45] Date of Patent: Feb. 3, 1987

[54] PERFORATING GUN FOR INITIATION OF SHOOTING FROM BOTTOM TO TOP

[75] Inventor: Rodney J. Wetzel, Woodlands, Tex.

[73] Assignee: Baker Oil Tools, Inc., Orange, Calif.

[21] Appl. No.: 743,429

[22] Filed: Jun. 11, 1985

[51] Int. Cl.[4] ..... E21B 43/1185

[52] U.S. Cl. ..... 175/4.6; 89/1.15; 102/310; 166/55

[58] Field of Search ..... 175/4.6, 4.54–4.56, 175/4.52; 102/310, 320; 89/1.15; 166/55, 55.1

[56] References Cited

U.S. PATENT DOCUMENTS

| | | | |
|---|---|---|---|
| 2,831,429 | 4/1958 | Moore | 89/1.15 |
| 2,935,020 | 5/1960 | Howard et al. | 175/4.6 |
| 2,968,243 | 1/1961 | Turechek | 175/4.6 |
| 3,128,702 | 4/1964 | Christopher | 175/4.6 |
| 3,245,485 | 4/1966 | Bell | 175/4.6 |
| 4,140,188 | 2/1979 | Vann | 175/4.51 |
| 4,523,649 | 6/1985 | Stout | 175/4.6 |

FOREIGN PATENT DOCUMENTS

| | | | |
|---|---|---|---|
| 258201 | 10/1970 | U.S.S.R. | 175/4.55 |

*Primary Examiner*—James A. Leppink

*Assistant Examiner*—Hoang C. Dang

*Attorney, Agent, or Firm*—Norvell & Associates

[57] ABSTRACT

An apparatus for effecting the firing of a multisection perforating gun having a plurality of vertically spaced shaped charges wherein the firing is accomplished from the lowermost shaped charge to the uppermost shaped charge. The detonation of the shaped charges is accomplished by a primer cord which is detonated only by a booster charge located in the bottom portion of the assembled perforating gun housing. Hollow nipples are utilized to effect the assembly of the plurality of tubular gun sections in axially stacked relationship and a fusible tubular guide element is provided between each adjacent pair of nipples so as to permit a continuous primer cord, as well as a fusible cord, to be concurrently inserted throughout the length of the gun. The fusible cord is ignited by a firing mechanism located in the top portions of the gun or at the well surface, and the fusible cord transfers the ignition to the booster charge located in the bottom of the perforating gun housing, which in turn detonates the primer cord, with the resulting detonation effecting the firing of the shaped charges from the lowermost charges upwardly to the uppermost charges.

8 Claims, 6 Drawing Figures

PERFORATING GUN FOR INITIATION OF SHOOTING FROM BOTTOM TO TOP

CROSS-REFERENCE TO RELATED APPLICATION

This application is related in subject matter to: U.S. patent application Ser. No. 743,580, entitled "Method and Apparatus for Initiating Subterranean Well Perforating Gun Firing from Bottom to Top"; U.S. patent application Ser. No. 743,579, entitled "Method and Apparatus for Firing Multisection Perforating Guns"; and U.S. patent application Ser. No. 743,578, entitled "Boosterless Perforating Gun and Method of Assembly".

BACKGROUND OF THE INVENTION

1. Field of the Invention: The invention relates to perforating guns employed for perforating the casing and the adjoining production formation of a subterranean well, particularly to a gun wherein the vertically spaced shaped charges are successively fired from the bottommost charge upwardly to the uppermost charge.

2. History of the Prior Art: The utilization of a plurality of vertically and angularly spaced shaped charges to effect the perforation of a subterranean well represents the modern approach to achieving perforation of the well casing and the adjoining production formation. In recent years, it has become desirable to mount the shaped charges of the perforating gun within or upon a tubular housing which in turn is run into the well on the bottom of a tubular string, which may comprise the production string. Such shaped charges are substantially concurrently fired by the detonation of a primer cord which passes successively past the primer ends of each of the shaped charge containers.

It is not uncommon for the zone to be perforated to extend from ten to two thousand feet in length, thus, necessitating the fabrication of the perforating gun as a plurality of axially stacked, substantially identical gun sections. The transmission of the firing energy from the uppermost gun section to the lowermost section is commonly accomplished through the mounting of booster charges on each of the ends of a primer cord which is utilized only within an individual gun section. The booster charges are required to insure that sufficient energy is transmitted from one primer cord to the next to insure the successive ignition of all primer cords. There have been many instances of unsuccessful transfer of ignition energy from one gun section to the next, necessitating the removal of the perforating gun from the well to effect the necessary replacements of primer cords and booster charges to accomplish the firing of the remaining shaped charges.

Additionally, with the assembly of such a large number of individual gun sections, it is difficult to effect a sealed connection of all components of the perforating gun housing containing the gun charges in order that the interior of the housing is isolated from well fluids. As is well known to those skilled in the art, even the most carefully assembled units may, after being run into the well, and particularly a well having substantial deviations from the true vertical, experience stresses which result in the creation of leakage paths for well fluids to enter the perforating gun housing. Since the shaped charges are normally sealed within a container, and the primer cord for activating such shaped charges is encased within a thermoplastic tube, the existence of well fluids within the perforating gun housing will not necessarily prevent the detonation of the primer cord and the subsequent detonation of the shaped charges. The presence of fluids within the gun housing during the detonation of the shaped charges, results in a very substantial hydraulic expansion force being exerted on the wall of the perforating gun housing. In some instances, the expansion is sufficient to bulge the housing into tight engagement with the casing and thus effectively prevent the removal of the perforating gun from the well. It follows that there is a definite need in the subterranean well industry for a method and apparatus for perforating the well casing and the adjoining production formation which will not fire the shaped charges when the lower portions of the perforating gun housing are partially filled with well fluids. Additionally, there is the further requirement that the resulting multisection perforating gun be capable of convenient and safe assembly at the well site, and this can only be accomplished by substantially reducing the number of booster charges that must be assembled to the primer cord by which the shaped charges are to be fired.

SUMMARY OF THE INVENTION

The invention contemplates a method of firing the vertically spaced shaped charges, which are respectively disposed in a plurality of axially stacked hollow housings, by detonating the primer cord by which the shaped charges are successively ignited from the bottom end of the gun assembly upwardly, thus firing the lowermost shaped charges first and the uppermost shaped charges last. The detonation of the primer cord is accomplished by a booster charge which is disposed at the bottom of the multisection housing containing the shaped charges. Such booster charge is disposed in a thin-walled container which is apertured at one or more areas to provide fluid communication with the interior of the assembled perforating gun housing. It follows that if any significant quantities of well fluids leak into the perforating gun housing, they will also leak into the booster charge container and effectively prevent the firing of the booster charge. If the booster charge is not fired, the primer cord is not detonated and no firing of the vertically spaced shaped charges can occur.

In accordance with the preferred modification of this invention, the ignition of the booster charge disposed at the bottom of the multisection perforating gun housing is accomplished by a fusible cord which is inserted downwardly through the perforating gun in contiguous relation to the primer cord. The deflagration or fusion rate of the fusible cord is sufficiently low as to be incapable of detonating either the primer cord or the shaped charges, but is sufficient to ignite the booster charge disposed at the bottom of the perforating gun housing, assuming that such housing has not been penetrated by well fluids.

The method and apparatus of this invention further contemplates employing a single continuous length of primer cord which extends thru the multisection gun for the entire vertical distance of the shaped charges, thus eliminating the necessity of mounting booster charges on each end of short lengths of primer cord which conventionally traverse only the shaped charges contained in a single gun section. Moreover, the fusible cord is preferable inserted into the assembled multisection perforating gun concurrently with the primer cord, either by being secured to the primer cord in contiguous relation, or being mounted within the primer cord in telescopic or parallel relation. To facilitate the insertion of the combined primer cord and fusible cord through all of the axially stacked gun section, the gun sections are interconnected by hollow nipples and each individual gun section is provided with a relatively small diameter fusible guide tubing which is coaxially disposed within the gun section and has a bore sufficiently large to freely accommodate the combined primer cord and fusible cord for insertion therethrough. Additionally, the exterior of the fusible guide tubing is disposed in close proximity to the inner, primer containing ends of each of the shaped charge containers which are mounted in each of the sections of the multisection perforating gun.

The top end of the fusible cord is then connected to a primer charge assembled in conventional fashion beneath a firing mechanism mounted either at the top of the assembled gun or at the well surface.

With the aforedescribed construction, the entire gun, together with any related equipment, such as screens, packer, and/or gravel pack apparatus, is then lowered into the well so as to position the perforating gun adjacent the zone to be perforated. The actuation of the firing mechanism in any conventional manner, such as electrically or by dropping a detonating bar through the bore of the tubular string carrying the perforating gun into the well, will effect the ignition of the primer charge which in turn will ignite the top end of the fusible cord. The heat and shock wave developed by the fusible cord will pass downwardly to the booster charge disposed in the bottom of the assembled multisection perforating gun and the ignition of the booster charge effects the detonation of the primer cord. The resulting detonation will move upwardly along the length of the continuous primer cord and effect the successive detonation of the shaped charges, beginning with the lowermost set of charges and extending successively up to the uppermost set of shaped charges.

Thus, the assembling and firing of a perforating gun embodying this invention is accomplished in a more efficient manner which also provides a much higher degree of safety for the well personnel than has heretofore been possible. Additionally, the method and apparatus of this invention effectively prevents the firing of the shaped charges whenever the perforating gun housing has been penetrated by well fluids.

Further advantages of the invention will be readily apparent to those skilled in the art from the following detailed description, taken in conjunction with the annexed sheets of drawings, on which are shown several preferred embodiments of the invention.

DESCRIPTION OF THE PREFERRED EMBODIMENT

Figure 1A:
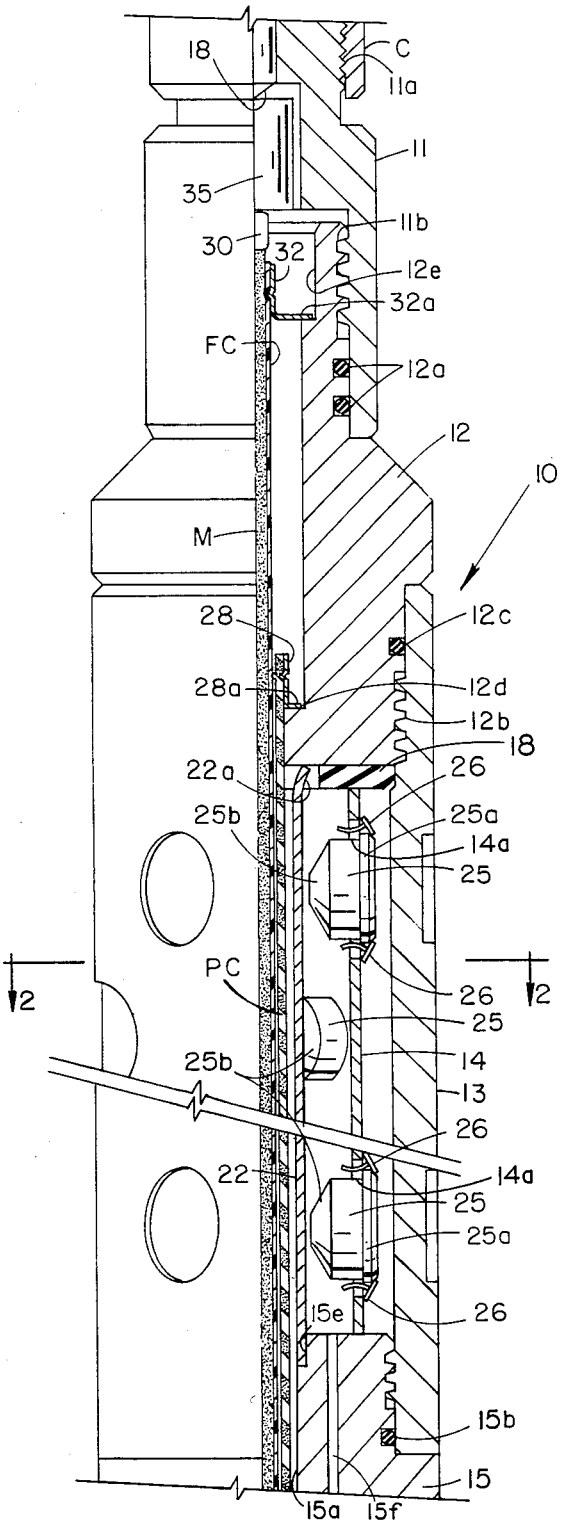
FIGS. 1A and 1B collectively represent a vertical sectional view of a multisection well perforating gun embodying this invention.
Figure 1B:
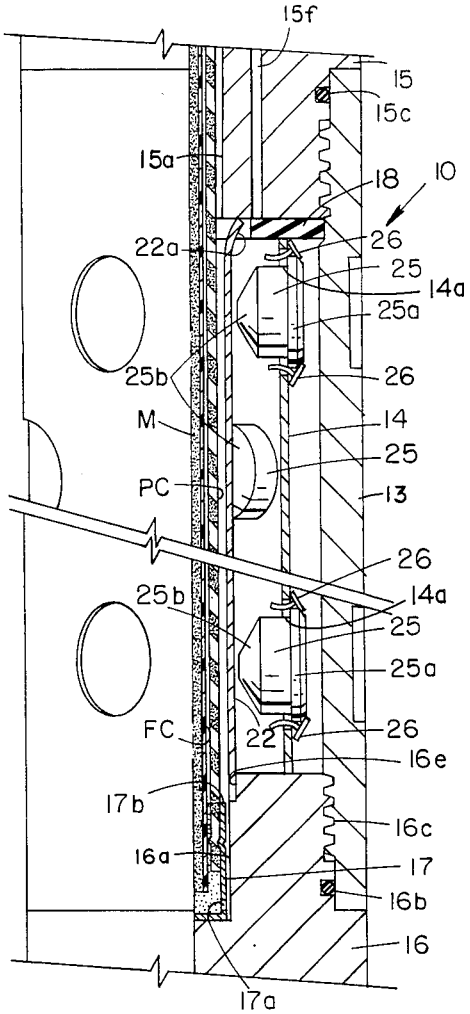
Figure 2:
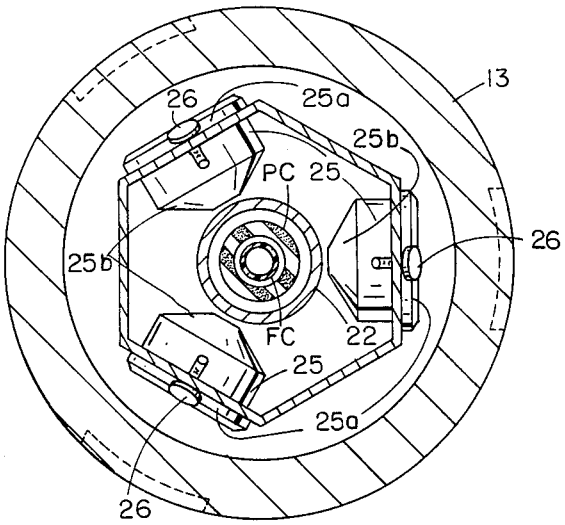
FIG. 2 is an enlarged scale sectional view taken on the plane 2—2 of FIG. 1A.

Referring to FIGS. 1A and 1B, there is shown an assembled, multisection perforating gun 10. As is conventional, the perforating gun 10 terminates at its upper end in a firing head 11 which is threadably connected by external threads **11*a* to the lower end of well conduit C. Internal threads 11*b* are provided at the lower end of firing head 11 for connection to a booster chamber sub 12. O-rings 12*a* sealably secure this threaded connection. Booster chamber sub 12 is in turn connected by external threads 12*b* to a cylindrical housing 13. O-ring seal 12*c*** effects the sealing of this threaded connection.

The cylindrical housing 13 comprises one section of a multisection perforating gun. Each gun section is substantially identical, comprising the cylindrical housing 13 which is internally threaded at both its upper and lower ends for interconnection by externally threaded hollow nipples 15 and sealed by O-rings **15*b* and 15*c*. Each housing section 13 is preferably limited in length to about ten feet and, since perforating guns often require a total length in excess of one hundred feet, it is readily apparent that a large number of sections must be sealably interconnected in vertically stacked relationship. Each nipple is provided with an axial bore 15*f*** so any fluid leaking into the assembly proceeds to the bottom of the gun.

The lowermost housing section 13 is provided at its bottom end with a solid plug 16 which has external threads **16*c* for engaging the internal threads in the lowermost housing section 13 and mounts O-ring seal 16*b* for sealing the threaded connection. Plug 16 defines an upwardly open chamber or well 16*a* within which a thin-walled container 17 containing a booster charge 20 is positioned. Container 17 is provided with one or more apertures 17*a* to provide fluid communication with the interior of the perforating gun housing. Hence, any well fluids inadvertently leaking into any of the housing sections 13 will collect in the plug chamber 16*c* and penetrate the booster charge 20 through the apertures 17*a***.

A plurality of vertically and angularly spaced shaped charge containers 25 are mounted within each housing section 13. The specific manner of mounting such charges forms no part of this invention and they may be either sealably mounted in the walls of the housing sections 13 or, as illustrated in FIGS. 1A and 1B, may be mounted in vertically spaced apertures **14*a* provided in the walls of a polygonal tubular carrier 14 which is concentrically positioned within the interior of each tubular housing section 13. For example, the bottom end of each polygonal carrier 14 may rest on the top surface of the hollow connecting nipples 15. An elastomeric washer 18 is positioned between the top end of carrier 14 and the bottom surface of nipple 15 or sub 12 in the case of the top gun section. Each shaped charge container 25 is provided with an enlarged flange 25*a* and this flange is held in the respective aperture in the carrier 14 by blind rivets 26** in the manner described in detail in co-pending application Ser. No. 432,481, filed Oct. 4, 1982, and assigned to the Assignee of this application.

The bore **15*a* of each hollow nipple 15 is provided at its upper end with a short counterbore 15*e* and this counterbore mounts a length of guide tubing 22 in coaxial relationship with respect to the axis of the tubular housing 13. The outer surface of each guide tubing 22 is disposed closely adjacent to the inner, primer containing ends 25***b* of the shaped charge containers 25. The tubing 22 is fabricated from a relatively rigid, fusible material, such as aluminum, or any fusible, relatively rigid thermoplastic. The length of each tubing 22 corresponds to the spacing between the nipple 15 and the booster sub 12, in the case of the uppermost gun section, and between the nipples 15 in the case of all of the remaining gun sections except the lowermost, where tubing 22 fits between the lowermost nipple 15 and a counterbore 16*e* in plug 16. The upper end 22*a* of the tubing 22 is preferably outwardly flared for a purpose to be hereinafter described.

When it is desired to assemble a multisection perforating gun 10 having length dimensions ranging up to two thousand feet, it is readily apparent that the gun must be assembled at the well site and furthermore, assembled from the bottom up with the lowermost sections of the gun being inserted into the well bore and then moved successively downwardly as the assembly of each gun section proceeds. Thus, each gun section may have the lower end of its tubular housing 13 connected to the threads on the upper end of the adjacent lower nipple 15. The shaped charge containers 25 may be assembled in the housing 13 either at the factory or at the well site, but in either event, there is little danger involved in such an assembly operation since the shaped charge containers are not susceptible to detonation by shock or impact. In any event, when the assembly is completed, and the desired length of perforating gun achieved, the assembled gun may be lowered into the well so that all of the shaped charge containers 25 are disposed below the surface.

In accordance with this invention, the gun 10 is then armed through the simple expedient of lowering contiguous continuous lengths of a primer cord PC and fusible cord FC through the aligned bore of the booster sub 12, the bore 22 of the uppermost fusible tube 22, the bore of the uppermost hollow nipple 15 and then successively through the bores of the fusible tubes 22 and hollow nipples 15 until the primer cord PC is disposed adjacent all of the shaped charge containers 25 incorporated in the multisection gun and the lower ends of both the primer cord PC and the fusible cord FC are inserted into the booster charge container 17. Preferably the upper end of container 17 is crimped at 17*b* around the primer cord PC and fusible cord FC and may thus be inserted into the chamber 16*a* in bottom plug 16. The flared upper end 22*a* of each guide tube 22 obviously facilitates the insertion of the contiguous primer cord PC and fusible cord FC.

In accordance with the modification of this invention illustrated in FIGS. 1A and 1B, the primer cord PC is formed of a tubular configuration and encompasses, in telescopic relationship, the fusible cord FC. The tubular primer cord PC may be any one of several commonly utilized primer cords formed from cyclotrimethylene trinitramine material, such as the primer cord sold by the Ensign Bickford Co. of Simsbury, Conn. under the trademark "PRIMACORD". Such primer cord material is not readily ignitable but, when ignited, it detonates with a detonation rate in excess of eight thousand meters per second. The resultant heat and shock wave is more than sufficient to effect the fragmentation and burning of the fusible guide tubes 22 and the detonation of all the shaped charge containers 25 disposed along primer cord PC.

In accordance with this invention, the primer cord PC is detonated at its lower end by ignition of the booster charge 20. Such ignition is accomplished by the fusible cord FC which is preferably a shock tube sold under the trademark "NONEL" by the Ensign Bickford Company of Simsbury, Conn. The Nonel shock tube is hollow plastic tube of about 3/16-inch diameter with a very small amount of reactive material M coating the inside wall which propogates a flame or shock wave signal at a rate on the order of one thousand eight hundred thirty (1830) meters feet per second. The Nonel shock tube FC is thus incapable of effecting the detonation of the primer cord PC, even though it is disposed in contiguous relationship thereto. It does transmit sufficient energy, however, to effect the ignition of the booster charge 20.

The primer cord PC extends upwardly from the booster charge 20 only so far as the uppermost shaped charge containers 25 where it may be supported by a crimped ferrule 28 having a radially projecting flange 28*a* engaging an upwardly facing shoulder 12*d* provided in booster chamber sub 12. The Nonel shock tube, however, extends upwardly through the bore of the booster charge sub 12 where it is conventionally secured in abutting relationship to a conventional humidity seal 30 and supported by a crimped ferrule 32 having an outwardly projecting support flange 32*a* which rests upon the bottom surface of the booster chamber 12*e* provided in the top end of the booster chamber sub 12.

Booster charge 20 may be any one of several well known charges commonly referred to as "DDT" charges which have the property of effecting the transition of a shock wave on the order of six thousand feet per second to sufficient intensity to effect the detonation of the primer cord PC. DDT charges are sold by the aforementioned Ensign Bickford Company under the trademark PRIMADETS TM. However, and this is important, such booster charge is quite sensitive to the presence of moisture and if any significant amount of well fluids collect in the bottom of the chamber 16*a* within which the booster charge 20 is located, it will be penetrated by such well fluids and rendered inoperative. It is therefore impossible to effect the ignition of the primer cord PC and the firing of the shaped charges in the presence of well fluids within the perforating gun 10.

The Nonel shock tube FC may be conveniently ignited by a primer charge 35 which may be electrically fired or, as shown in FIG. 1A, may be detonated by a firing pin 18 which is driven downwardly by fluid pressure or by a detonating bar (not shown) dropped from the surface of the well through the well conduit C.

Figure 4:
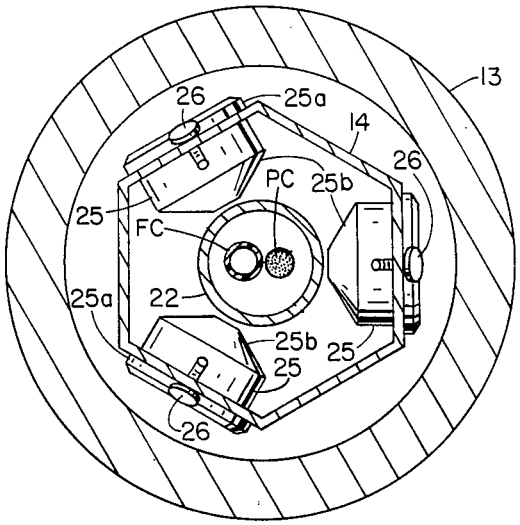
FIG. 4 is a view similar to FIG. 2 but representing an alternative embodiment of this invention.

Those skilled in the art will recognize that the relative positions of the Nonel shock tube FC and the primer cord PC may be reversed, i.e., the Nonel tube may comprise the outer element and receive a solid rod or tubular form of primer cord within its bore. Thus the term "cord" as employed in the claims, may comprise either a solid or tubular cross-section. Similarly, as illustrated in FIG. 4, the Nonel shock tube and primer cord PC may be contiguously united by fusion, adhesive, or clamps in side-by-side relationship as shown in FIG. 4 and fed concurrently down through the perforating gun with the bottom ends in contact with the booster charge 20.

While the primer cord PC is preferably continuous, those skilled in the art will recognize that sections of primer cord may be crimped together by conventional fasteners and, if desired, the primer cord may include booster charges connected at spaced intervals along its length. All such modifications are deemed to be included in the term "continuous primer cord".

Figure 3A:
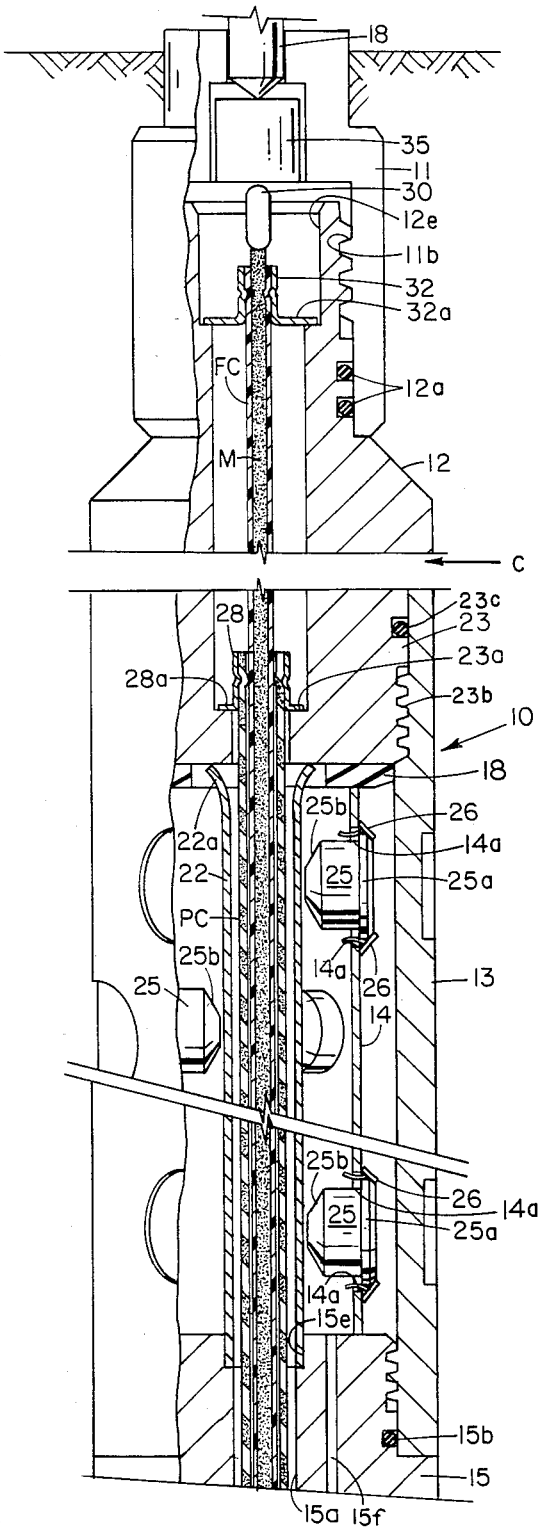
FIGS. 3A and 3B are views similar to FIGS. 1A and 1B respectively, but representing a still further modification of this invention wherein the firing mechanism is disposed at the well surface.
Figure 3B:
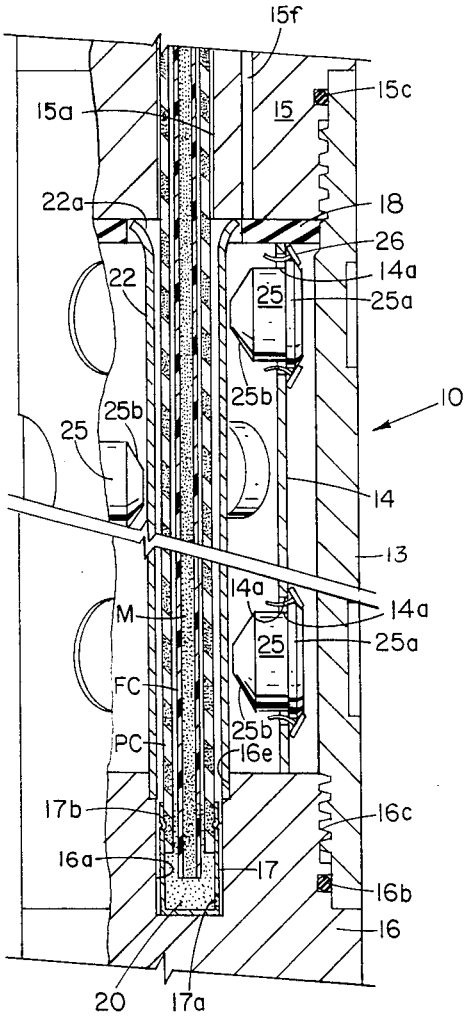

Referring now to FIGS. 3A and 3B, there is shown a modification of this invention wherein the firing mechanism is located considerably upwardly and away from the booster charge. In this modification, the primer cord PC extends upwardly from the booster charge 20 only so far as the uppermost shaped charge containers 25 where it may be supported by a crimped ferrule 28 having a radially projecting flange 28*a* engaging an upwardly facing shoulder 23*a* provided in a connecting sub 23 which sealably interconnects the uppermost tubular housing section 13 with the well conduit C by threads 23*b* and O-ring 23*c*. The firing mechanism may be actuated in a conventional fashion, such as by driving the firing pin 18 downwardly into impact engagement with the primer charge 35 which ignites the top of the fusible cord FC. With this arrangement, the Nonel shock tube FC extends to the booster charge 20 disposed in the bottom of the perforating gun 10 which is in its desired position within the well. This arrangement obviously provides the utmost safety for the operating personnel since the firing head 11, including the primer charge 35 are not assembled to the conduit string until all of the perforating gun is disposed downhole at its desired location. Thus, the possibilities of premature explosion of the shaped charges is essentially eliminated.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A perforating gun for an elongated production formation of a subterranean well, comprising, a plurality of shaped charge containers, each container having a primer containing end; carrier means for mounting said containers in vertically and angularly spaced relation with all said primer containing ends disposed substantially the same radial distance from the well axis; a fusible guide tube coaxially located in the well and defining a continuous axial passage adjacent said primer ends of said shaped charge containers; a continuous length of high detonating energy primer cord extending through said continuous axial passage; length of low detonating energy fusible cord also extending through said continuous axial passage, a firing mechanism at the top of said fusible guide tube for detonating said fusible cord, and a booster charge operatively connected to the bottom ends of said primer cord and said fusible cord, whereby said primer cord is detonated from the bottom up, thereby melting said fusible guide tube and firing said shaped charges in succession from the lowermost one upwardly.

2. The perforating gun of claim 1 wherein said fusible guide tube comprises aluminum.

3. The perforating gun of claim 1 wherein said fusible guide tube is formed of a fusible thermoplastic.

4. A multisection perforating gun for a subterranean well, comprising, for each such section: a tubular carrier, a plurality of shaped charge containers mounted in the wall of said tubular carrier in vertically and angularly spaced relation, each of said shaped charge containers having its primer containing end disposed adjacent the axis of said tubular carrier, and a guide tube of fusible material coaxially disposed in said tubular carrier and having its outer wall disposed in close proximity to the primer ends of said shaped charge containers; means including a plurality of hollow nipples for respectively connecting the tubular carriers in axially stacked relationship; a booster charge mounted below the lowermost of said shaped charge containers; a firing mechanism mounted on the upper end of the axially stacked tubular carriers; a continuous primer cord extending upwardly from said booster charge through the axially aligned bores of said guide tubes and said hollow nipples; a low detonating energy fusible cord extending downwardly through said axially aligned bores from said firing mechanism to said booster charge, said fusible cord having a deflagration rate inadequate to detonate said primer cord but adequate to detonate said booster charge, whereby detonation of said booster charge ignites said primer cord, melts said fusible guide tubes and discharges the shaped charges disposed in said shaped charge containers.

5. The perforating gun of claim 4 wherein said guide tubes comprise aluminum tubes.

6. The perforating gun of claim 4 wherein said guide tubes comprise thermoplastic tubes.

7. The perforating gun of claim 4 wherein said primer cord and said fusible cord are contiguously united.

8. The perforating gun of claim 4 wherein said primer cord and fusible cord are telescopically related.

* * * * *